US008336160B2

(12) United States Patent
Chen

(10) Patent No.: US 8,336,160 B2
(45) Date of Patent: Dec. 25, 2012

(54) DUAL ROTATING DEWATER BUCKET AND MOP THEREOF

(76) Inventor: Ching-Ming Chen, Taoyuan County (TW)

( * ) Notice: Subject to any disclaimer, the term of this patent is extended or adjusted under 35 U.S.C. 154(b) by 152 days.

(21) Appl. No.: 13/015,787

(22) Filed: Jan. 28, 2011

(65) Prior Publication Data

US 2012/0192373 A1 Aug. 2, 2012

(51) Int. Cl.
*A47L 13/58* (2006.01)

(52) U.S. Cl. ..... 15/260; 15/229.2; 15/229.6; 15/119.1; 15/264; 34/58

(58) Field of Classification Search ..... 15/25, 98, 15/119.1, 120.1, 120.2, 228, 229.1, 229.2, 15/229.6, 260, 263, 264; 34/58
See application file for complete search history.

(56) References Cited

U.S. PATENT DOCUMENTS

| | | | | |
|---|---|---|---|---|
| 8,056,179 | B2 * | 11/2011 | Hsu | 15/260 |
| 8,065,777 | B2 * | 11/2011 | Lin | 15/260 |
| 8,220,101 | B2 * | 7/2012 | Chen | 15/119.1 |
| 8,239,997 | B2 * | 8/2012 | Lin | 15/260 |
| 2006/0196001 | A1 * | 9/2006 | Demirtas | 15/260 |
| 2011/0113585 | A1 * | 5/2011 | Chu | 15/261 |
| 2011/0154602 | A1 * | 6/2011 | Chen | 15/228 |
| 2011/0173770 | A1 * | 7/2011 | Chen | 15/260 |
| 2011/0185532 | A1 * | 8/2011 | Lin | 15/260 |
| 2012/0090122 | A1 * | 4/2012 | Lin | 15/228 |
| 2012/0174335 | A1 * | 7/2012 | Shao | 15/260 |

FOREIGN PATENT DOCUMENTS

| | | | |
|---|---|---|---|
| EP | 1402808 | A1 * | 3/2004 |
| JP | 2012081209 | A * | 4/2012 |

* cited by examiner

*Primary Examiner* — Mark Spisich
*Assistant Examiner* — Michael Jennings
(74) *Attorney, Agent, or Firm* — Rosenberg, Klein & Lee

(57) ABSTRACT

The present invention discloses a dual rotating dewater bucket and a mop. The dewater bucket includes a freely-rotating dewater basket and a spindle member for receiving a cotton strip disc of the mop. With a passive dual rotating mechanism together with an active rotating mop, a cotton strip disc is placed in the spindle member and rotated, so that the cotton strips of the mop are stirred and spun towards the wavy bucket wall to remove dirt effectively, and then a dewater basket disposed in the same bucket body is used for spinning water absorbed by the cotton strips by a centrifugal force, similar to a washing machine or a dewatering machine to achieve both functions of cleaning and dewatering the mop without the need of a stepping action and provide a convenient and user-friendly operation and a safe application.

10 Claims, 14 Drawing Sheets

DUAL ROTATING DEWATER BUCKET AND MOP THEREOF

BACKGROUND OF THE INVENTION (a) Field of the Invention

The present invention relates to a dual rotating dewater bucket, and more particularly to a dewater bucket capable of removing dirt and dewatering cotton strips of the mop by stir and spin without stepping.

(b) Description of the Related Art

A mop is generally used as a floor cleaning tool, and a conventional dewater bucket is a tool for removing extra water from the mop by pressing cotton strips of the mop in order to dewater the cotton strips. With reference to FIG. 1 for a conventional dewater bucket 10, the dewater bucket comprises a casing 11, an installation portion 12, and a rotating unit 13, wherein the rotating unit 13 is driven by a pedal 131 to drive the dewater basket 14 to rotate and dewater a mop 16. However, the installation method of the dewater bucket 10 has the drawback of providing a cleaning space 15 for the mop 16 just in vertically up and down directions only. Related arts were disclosed in U.S. Pat. Publication Nos. US2010/0218335A1, 2010/0242205A1 and 2010/0287724A1.

In fact, the aforementioned method of cleaning a dirty mop 16 by moving it along the longitudinal Y-Y direction only cannot achieve the expected cleaning effect, and the dirt attached on the cotton strips 161 of the mop 16 cannot be removed from the cotton strips 161. In other words, the effect of cleaning the cotton strips 161 of the mop 16 by the dewater bucket is very limited.

Moreover, the dirt originally deposited at the bottom of the dewater bucket is repeatedly contacted with the cotton strips and attached onto the cotton strips again, and thus making the mop even dirtier than before.

Furthermore, the conventional dewater bucket comes with a complicated driving mechanism, and a user has to stand on the floor by one leg and step on the pedal 131 by the other. As a result, the operation is not smooth, and the user may lose balance and fall or even get injured easily. Obviously, the conventional dewater bucket requires improvements.

SUMMARY OF THE INVENTION

Therefore, a primary object of the present invention is to provide a dual rotating dewater bucket capable of achieving both effects of removing the dirt attached on a mop head and dewatering the mop in the same dewater bucket.

Another object of the present invention is to provide a dual rotating dewater bucket having a dual rotating mechanism to provide a convenient and user-friendly operation and a safe use without the need of a stepping motion.

In order to achieve the above-mentioned object, a dual rotating dewater bucket and a mop thereof have a first type of rotation for removing dirt from cotton strips of the mop and a second type of rotation for dewatering cotton strips of the mop, and the dual rotating dewater bucket comprises:

a) a bucket body, with an opening formed at the top surface of the bucket body, a higher first protruding base protruded from the bottom surface of the bucket towards the interior of the bucket body, and a lower second protruding base, and a portion of bucket wall of the bucket body corresponding to the second protruding base being a concave-convex surface;

b) a first support shaft, fixed to the first protruding base, and having an upper section protruded from the top surface of the first protruding base;

c) a second support shaft, fixed to the second protruding base, and having an upper section protruded from the top surface of the second protruding base;

d) a dewater basket, having a first shaft seat with an opening formed downwardly at the center of the bottom of the dewater basket, and mounted on the first support shaft, such that the dewater basket can be situated at a freely rotating state; and e) a spindle member, having a second shaft seat with an opening formed downwardly at the center of the bottom of the spindle member, and mounted on the second support shaft, such that a spindle member is at a freely rotating state, and the spindle member having a bearing seat disposed at the top surface of the spindle member;

the mop comprising:

i) an internal rod, being in a hollow shape;

ii) an external rod, being in a hollow shape, and having a bottom mounted on the top end of the internal rod for a relative linear extending or contracting displacement;

iii) a latching element, installed inside an opening at the top end of the internal rod, and having a through hole formed at the bottom surface of the latching element, and a passive ratchet disposed at an internal bottom side;

iv) a driving element, being a strip spiral shape, and installed in the external rod, and ascended, descended, and displaced synchronously with the external rod;

v) a brake element, installed in the latching element, and having a threaded sleeve disposed on a top surface of the brake element for receiving the driving element, and an active ratchet disposed at a bottom end of the brake element and corresponding to the passive ratchet of the latching element, such that when the driving element rotates, the latching element is driven to rotate in a single direction only;

vi) a fixing cover, having a through hole for passing the driving element, and mounted on an opening of the latching element;

vii) a locking structure, disposed at the external rod, for controlling the internal and external rods at fixed positions or at a relative contracting and extending state; and viii) a disc, installed at the bottom of the internal rod, and having a plurality of cotton strips disposed at the bottom of the disc, and a sheath body disposed at the center of the bottom of the disc and across the bearing seat of the dewater bucket, such that when the disc is driven and rotated by the internal rod, the disc can be rotated 360° on the spindle member to drive the cotton strips to be spun towards a concave-convex surface of the bucket wall to stir and remove dirt on the cotton strips.

DETAILED DESCRIPTION OF THE PREFERRED EMBODIMENT

Figure 1:
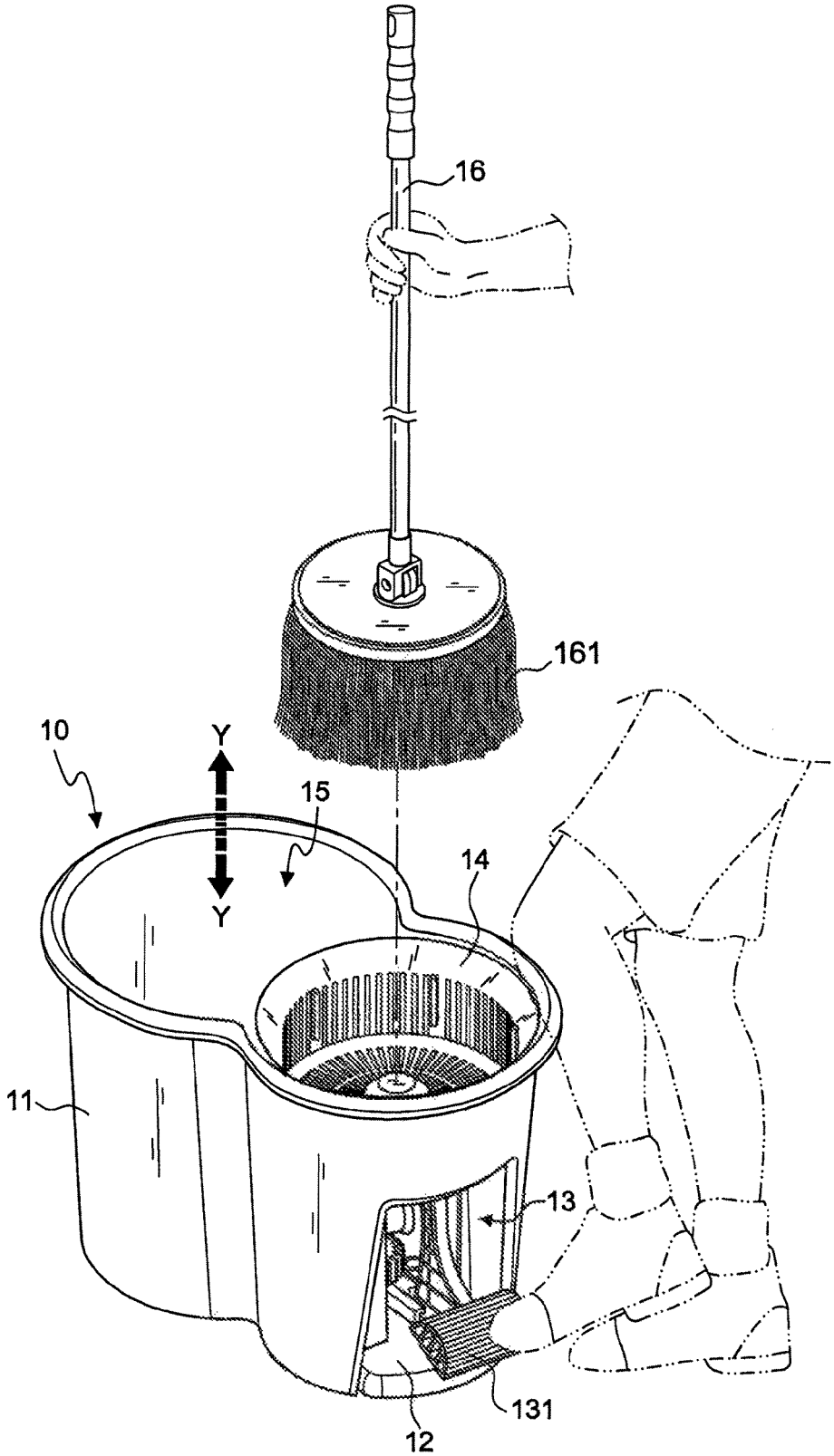
FIG.1 PRIOR ART
FIG. 1 is a schematic view of using a conventional dewater bucket.
Figure 2:
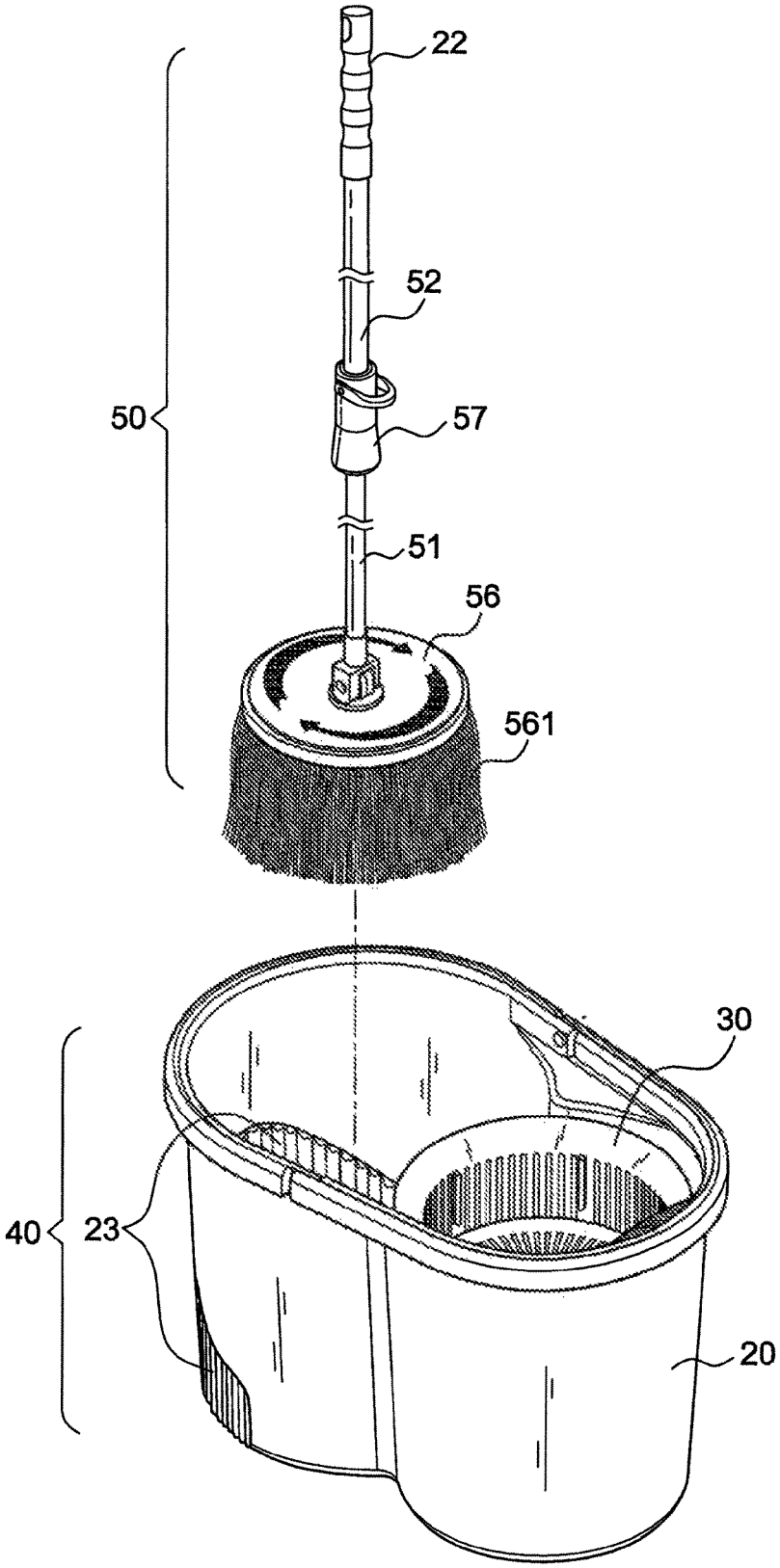
FIG. 2 is a perspective view of a dual rotating dewater bucket of the present invention.
Figure 3:
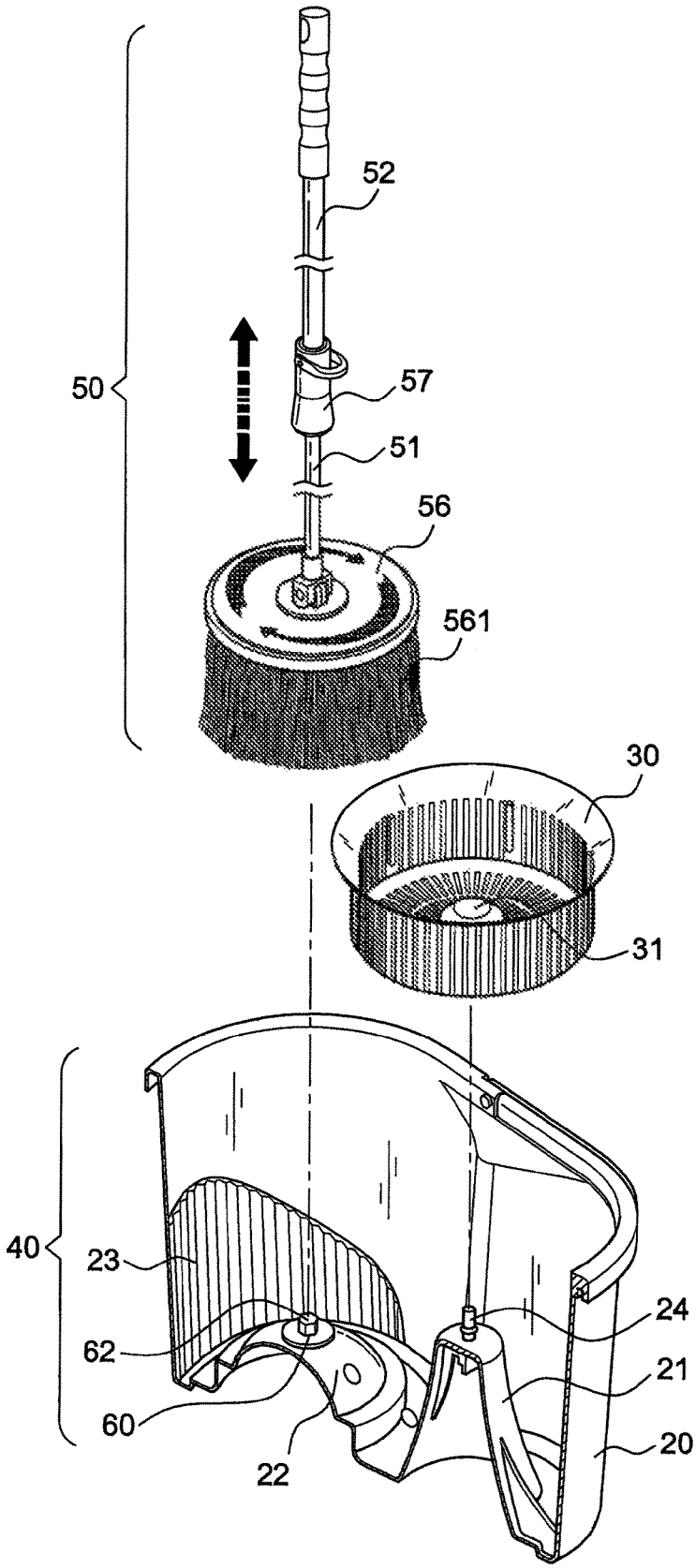
FIG. 3 is an exploded cross-sectional view of a dual rotating dewater bucket of the present invention.
Figure 4:
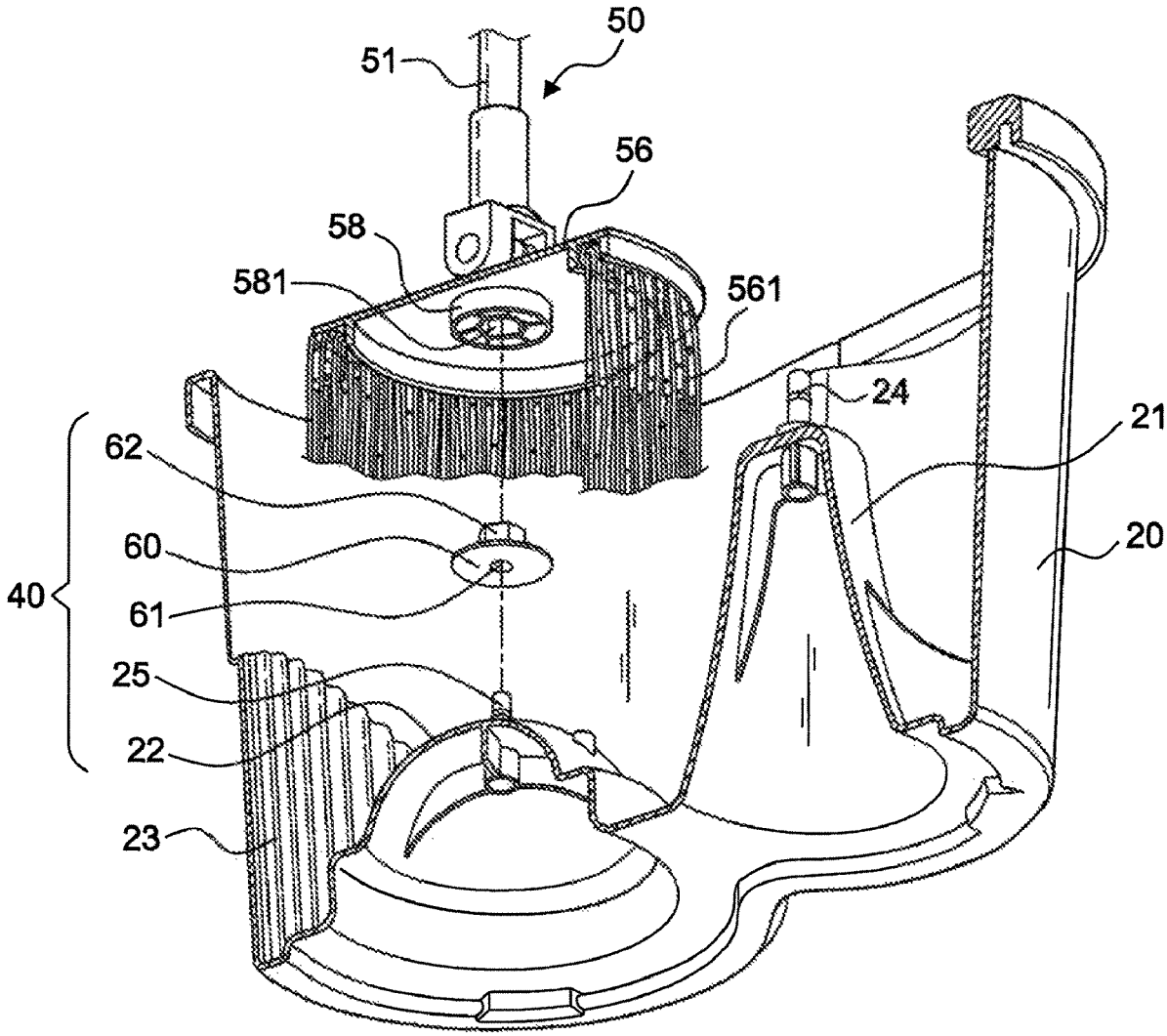
FIG. 4 is a cross-sectional view of a dual rotating dewater bucket of the present invention viewed at another angle.
Figure 5:
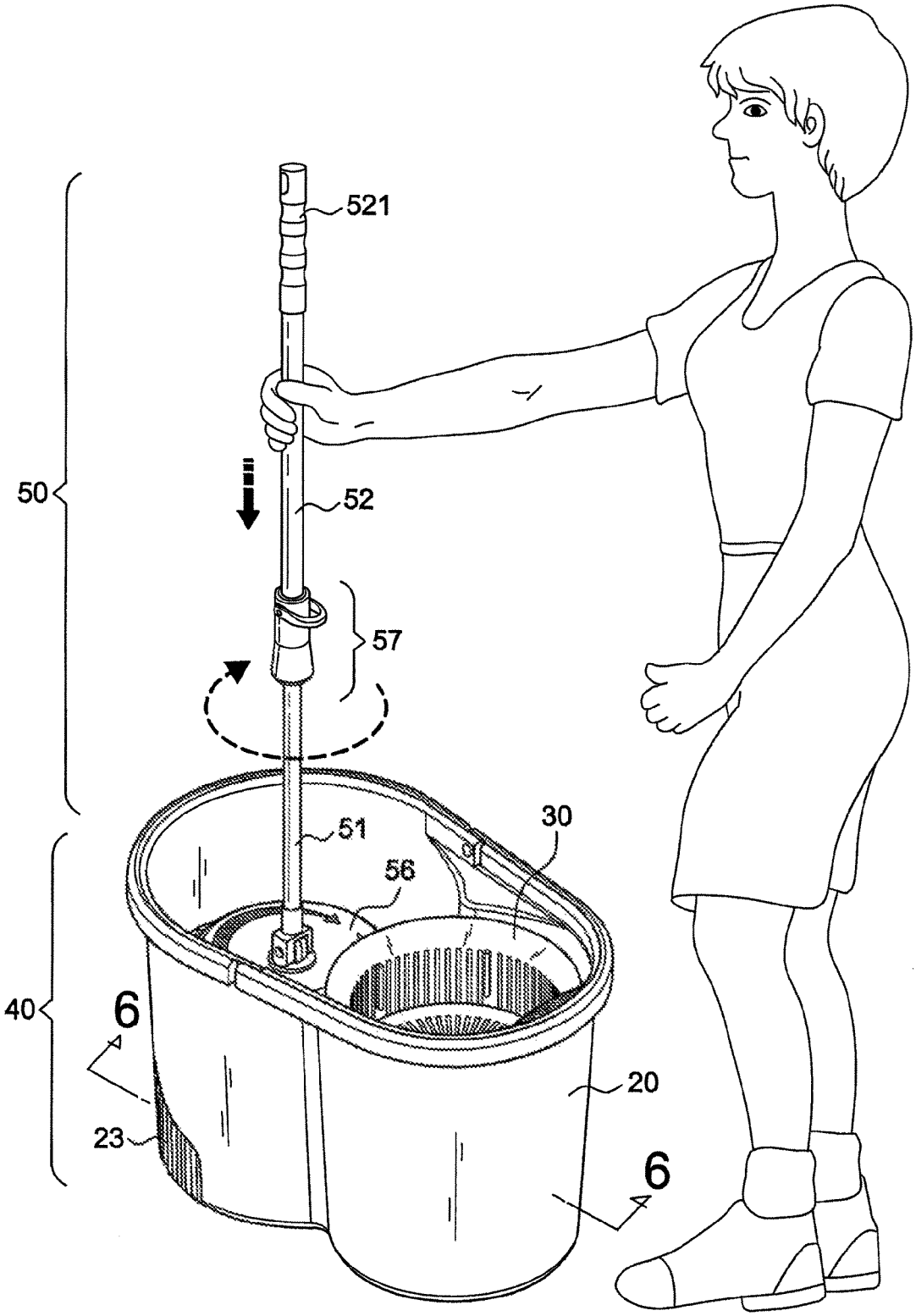
FIG. 5 is a schematic view of cleaning a mop by the application of the present invention.
Figure 6:
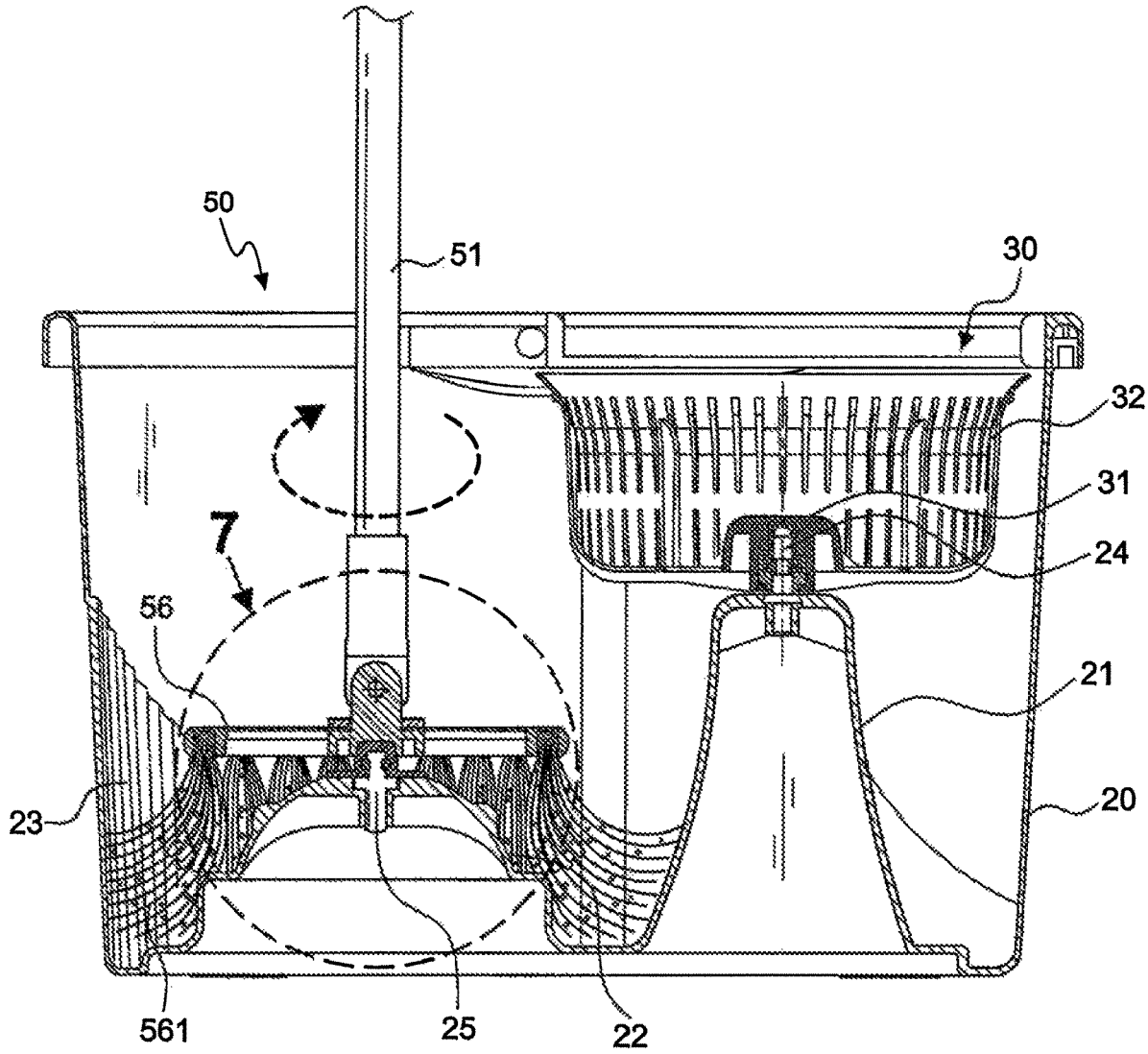
FIG. 6 is a cross-sectional view of Section 6-6 of FIG. 5.
Figure 7:
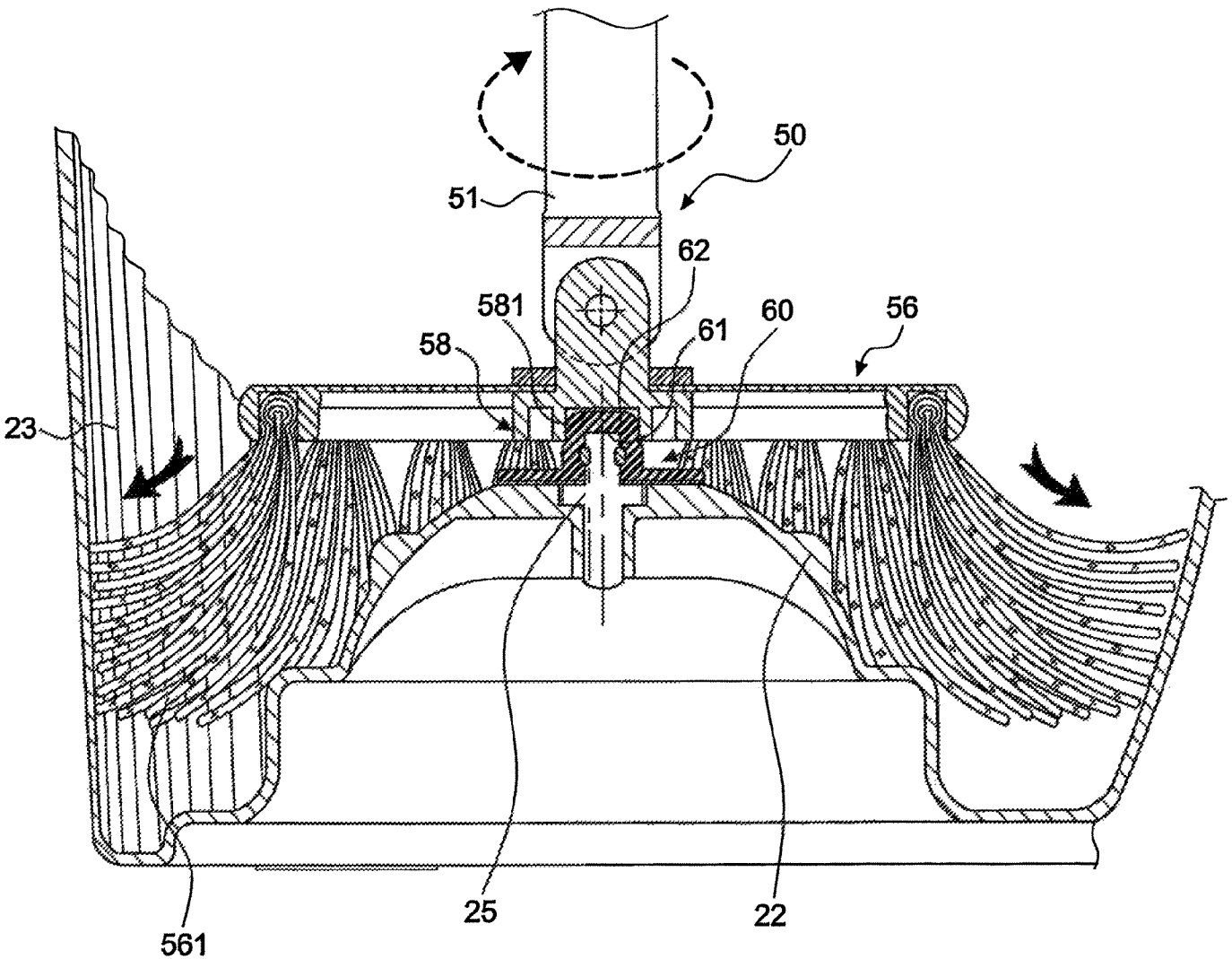
FIG. 7 is an enlarged top view of the main assembly as depicted in FIG. 6.
Figure 8:
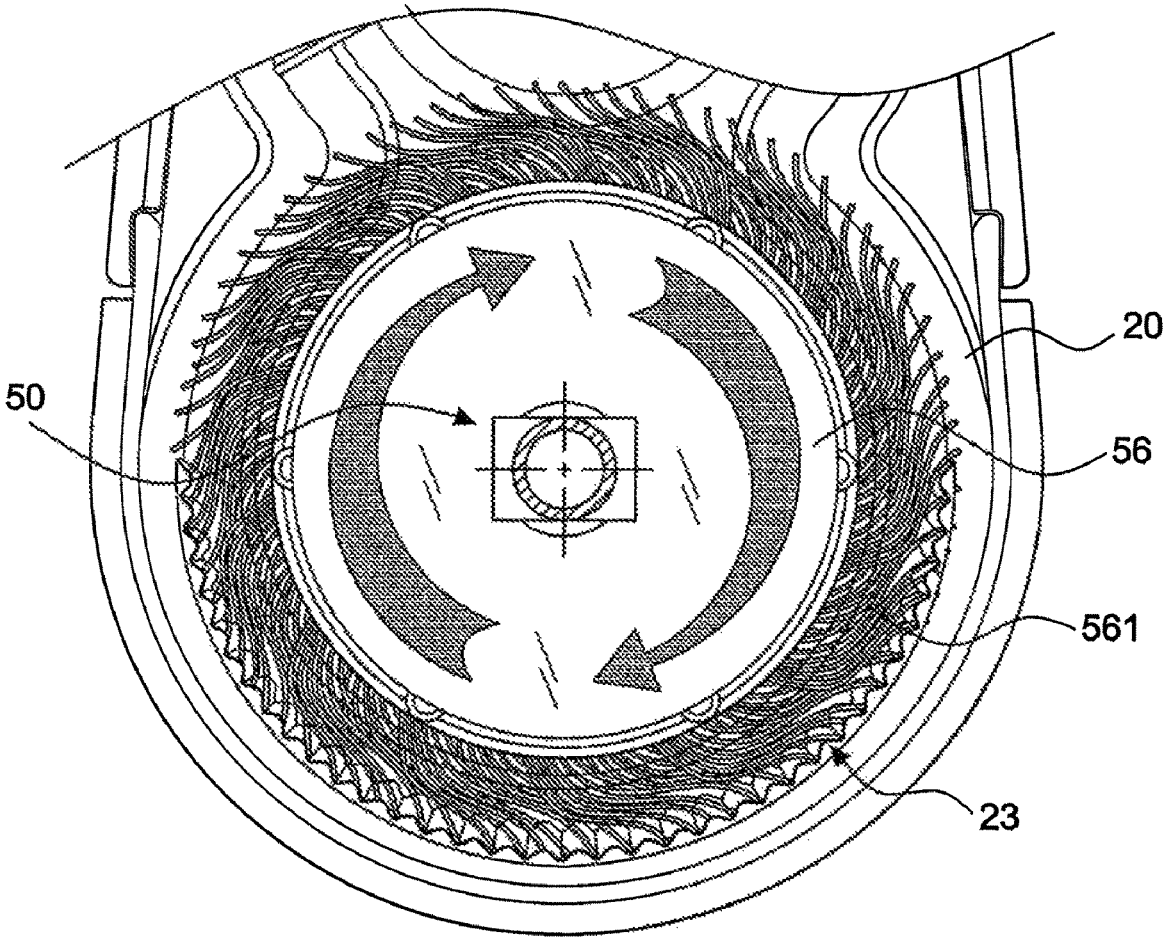
FIG. 8 is a cross-sectional view of Circle 7 of FIG. 6.

With reference to FIGS. 2 to 8 for a dual rotating dewater bucket 40 in accordance with a preferred embodiment of the present invention, the dual rotating dewater bucket 40 comprises:

a bucket body 20, having an opening formed at the top surface of the bucket body 20, a higher first protruding base 21 protruded from the bottom surface to the interior of the bucket body 20, and a lower second protruding base 22, and a portion of bucket wall of the bucket body 20 corresponding to the second protruding base 22 being a concave-convex surface 23, wherein the concave-convex surface 23 is in a wavy shape in this preferred embodiment;

a first support shaft 24, fixed to the first protruding base 21, and having an upper section protruded from the top surface of the first protruding base 21;

a second support shaft 25, fixed to the second protruding base 22, and having an upper section protruded from the top surface of the second protruding base 22;

a dewater basket 30, having a first shaft seat 31 with an opening formed at the center of the bottom surface, and mounted on the first support shaft 24, such that the dewater basket 30 is situated at a freely rotating state; and a spindle member 60, having a second shaft seat 61 with an opening formed at the center of the bottom surface and mounted on the second support shaft 25, such that the spindle member 60 is situated at a freely rotating state, and a bearing seat 62 formed on the top surface of the spindle member 60, provided for being mounted onto the center of a bottom disc 56 of a mop 50, and a mop 50 rotated synchronously with respect to the bearing seat 62.

In this preferred embodiment, the bearing seat 62 of the spindle member 60 is a protruding non-circular body, such as a polygonal convex body, and the bottom disc 56 of the mop 50 includes a sheath body 58 corresponding to the bearing seat 62, disposed across the bearing seat 62 and rotated synchronously. The sheath body 58 has a shape corresponding to the inwardly concave polygonal cap 581.

With the foregoing assembly, the spindle member 60 can be rotated freely on the top surface of the second protruding base 21 by using the second support shaft 25 as an axle center, and the bearing seat 62 on the top surface of the bearing seat 62 is provided for putting and positioning the mop 50. If a user wants to remove dirt from the cotton strips 561 of the mop 50, the user puts the disc 56 into the bucket body 20 and at a position on the spindle member 60. Now, the sheath body 58 at the center of the bottom of the disc 56 with a cap 581 is covered onto the bearing seat 62 such that the mop 50 is positioned and situated at a freely rotating state in the bucket body 20. Therefore, when the user operates and rotates the mop 50, the cotton strips 561 of the mop 50 are spun by a centrifugal force towards the wavy shaped concave-convex surface 23, and the concave-convex surface 23 has a function similar to a washboard for stirring the cotton strips 561, and the bucket body 20 is similar to a washing machine for removing dust or dirt attached onto the cotton strips 561. In addition, the rinsing function of the present invention does not require any dynamic force such as installing a motor in bucket body 20, but it simply makes use of the turning force produced by the rotation of the mop 50 to achieve the self-rinsing effect.

Figure 9:
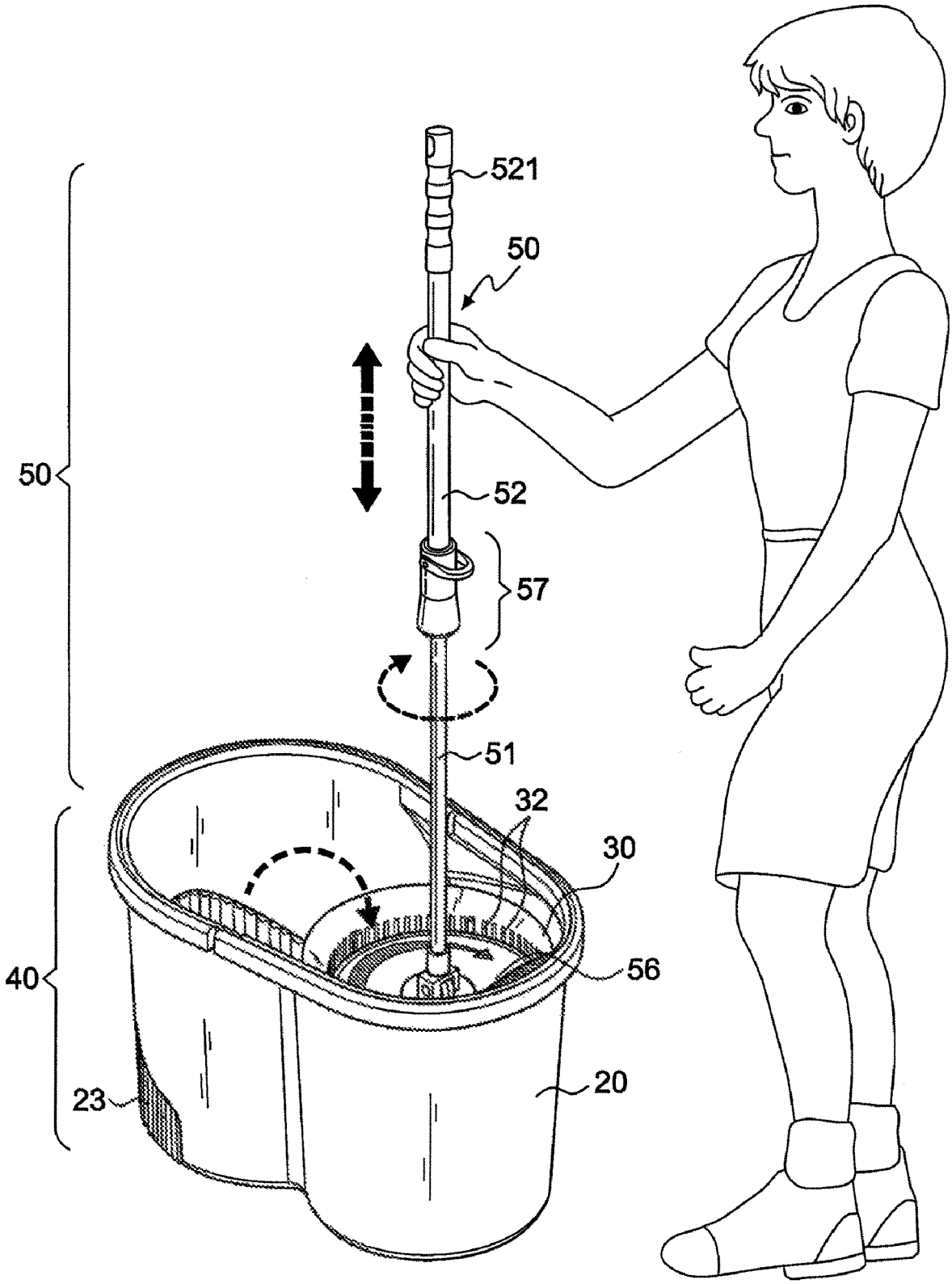
FIG. 9 is a schematic view of dewatering a mop by the application of the present invention.
Figure 10:
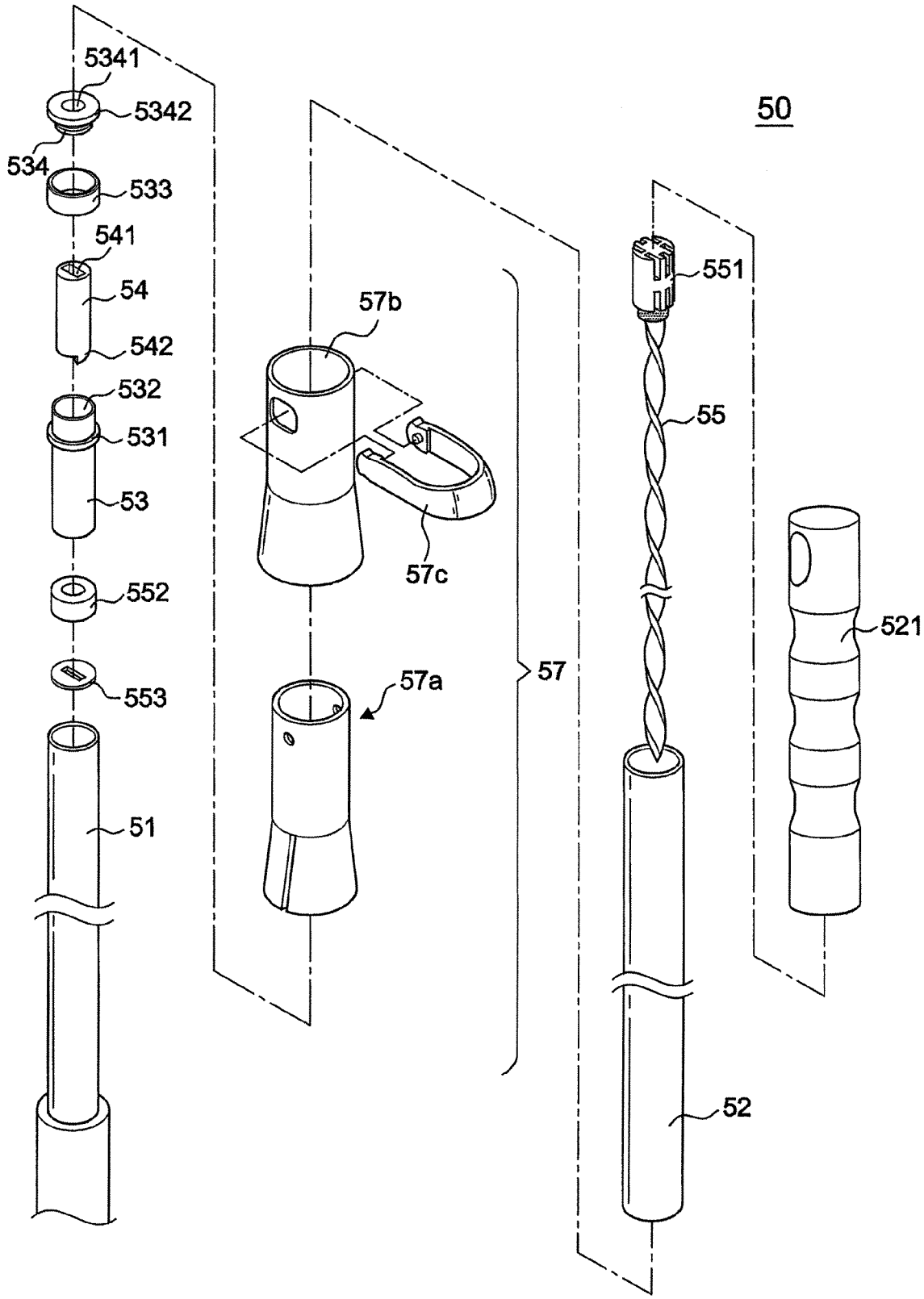
FIG. 10 is an exploded view of a mop of the present invention.

In FIG. 9, the disc 56 of the mop 50 with the dirt removed, but with the water still attached, is placed in the dewater basket 30, and the mop 50 is operated to rotate the disc 56 and synchronously drive the dewater basket 30 to rotate, and a centrifugal force is used for dewatering the cotton strips 561 of the disc 56, and water is spun off from the dewatering hole 32. The dual rotating dewater bucket 40 of the present invention is similar to a washing machine and a dewatering machine and capable of achieving both cleaning and dewatering effects.

Figure 11:
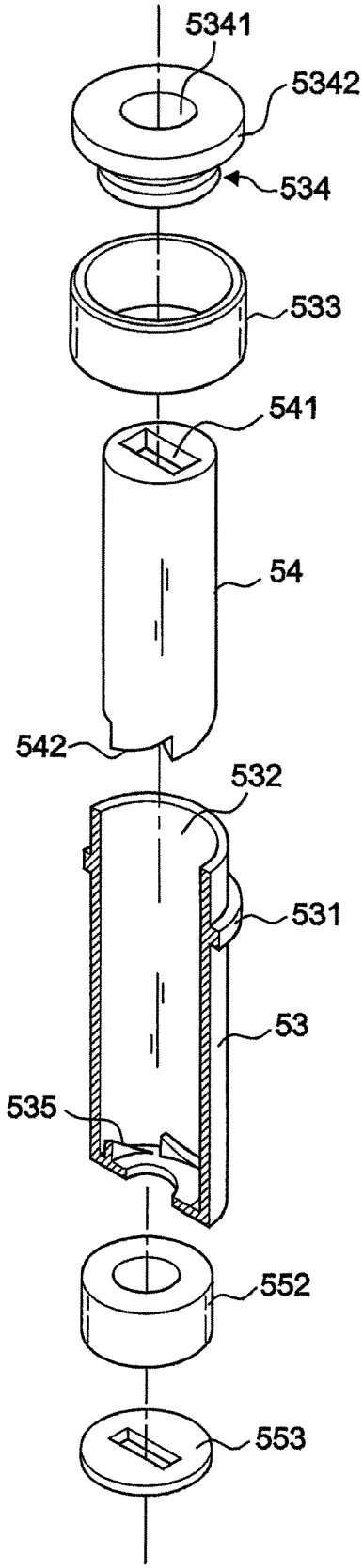
FIG. 11 is an exploded view of a mop latching element of the present invention.
Figure 12:
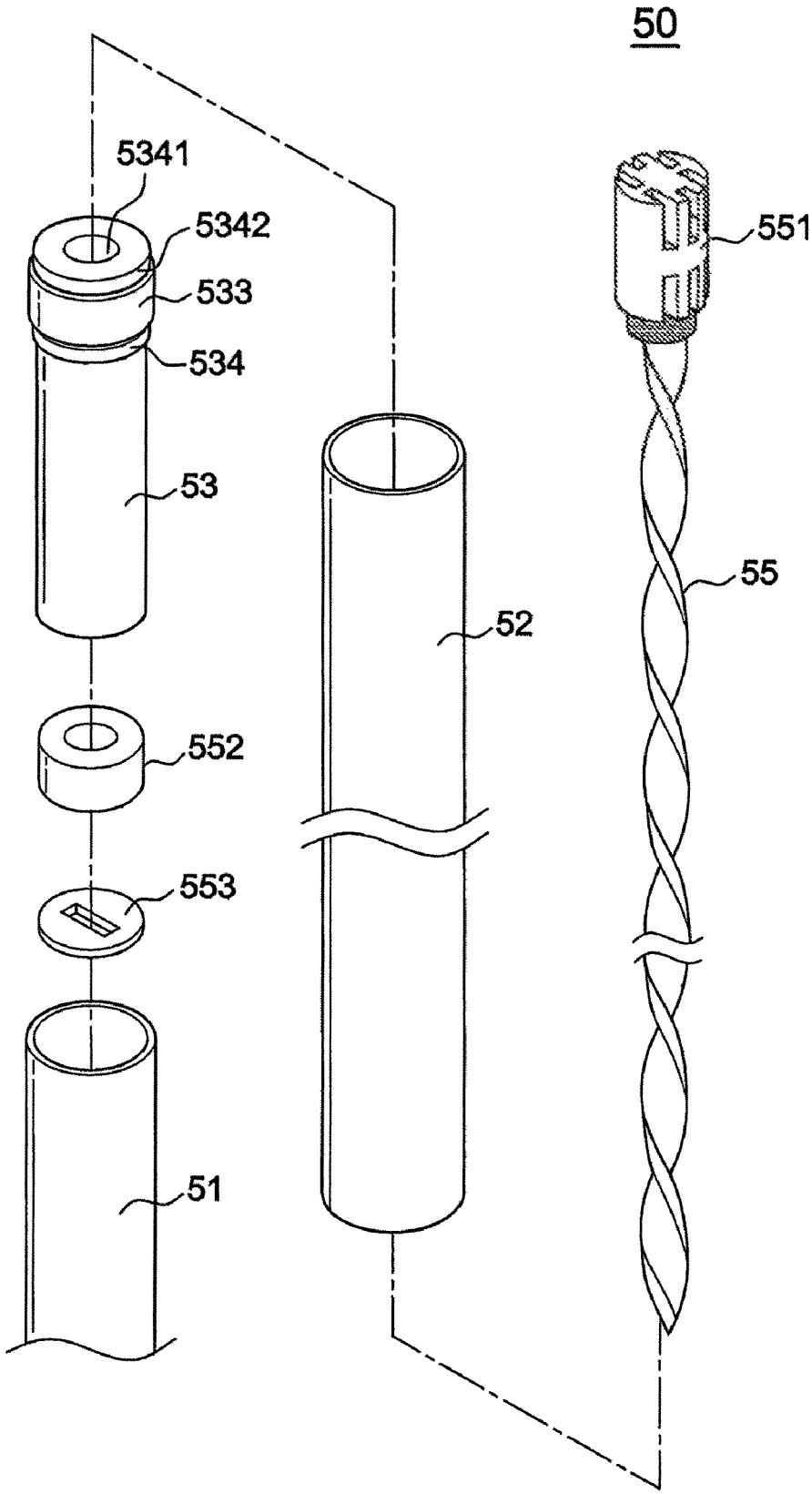
FIG. 12 is an exploded view of internal and external rods and a driving element of a mop of the present invention.
Figure 13:
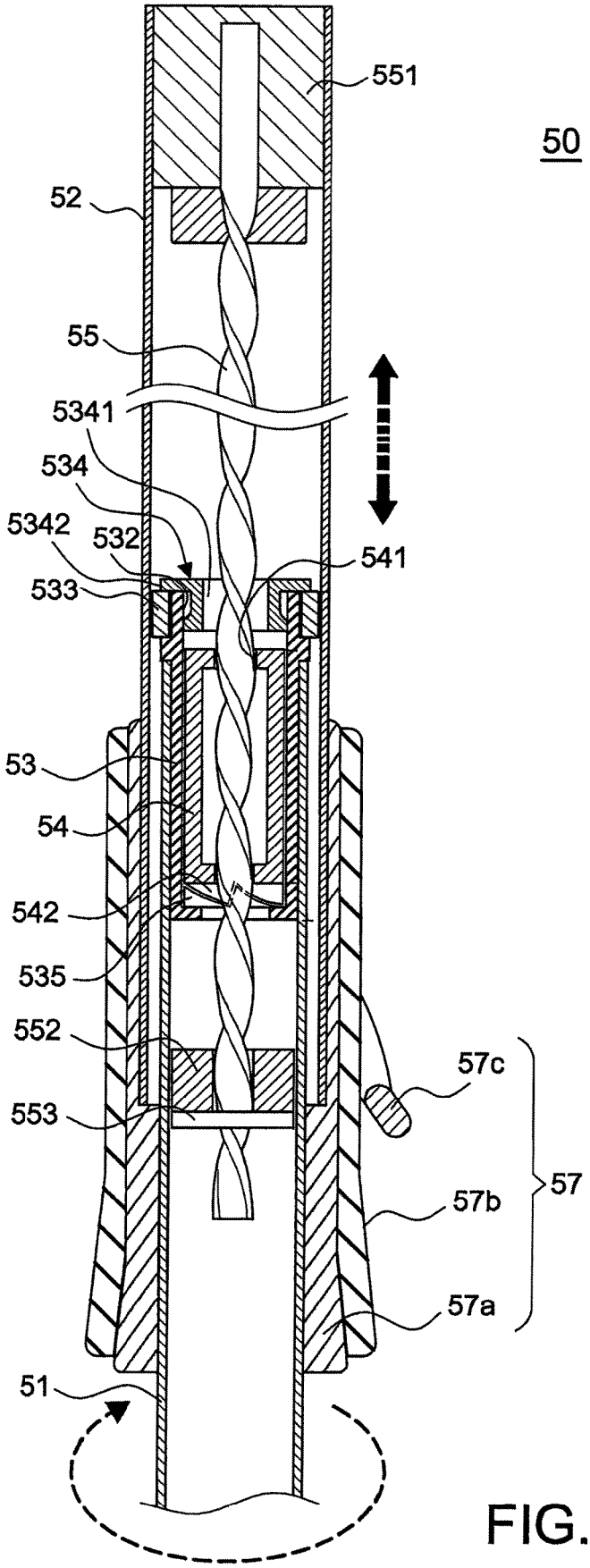
FIG. 13 is a cross-sectional view of a mop of the present invention.
Figure 14:
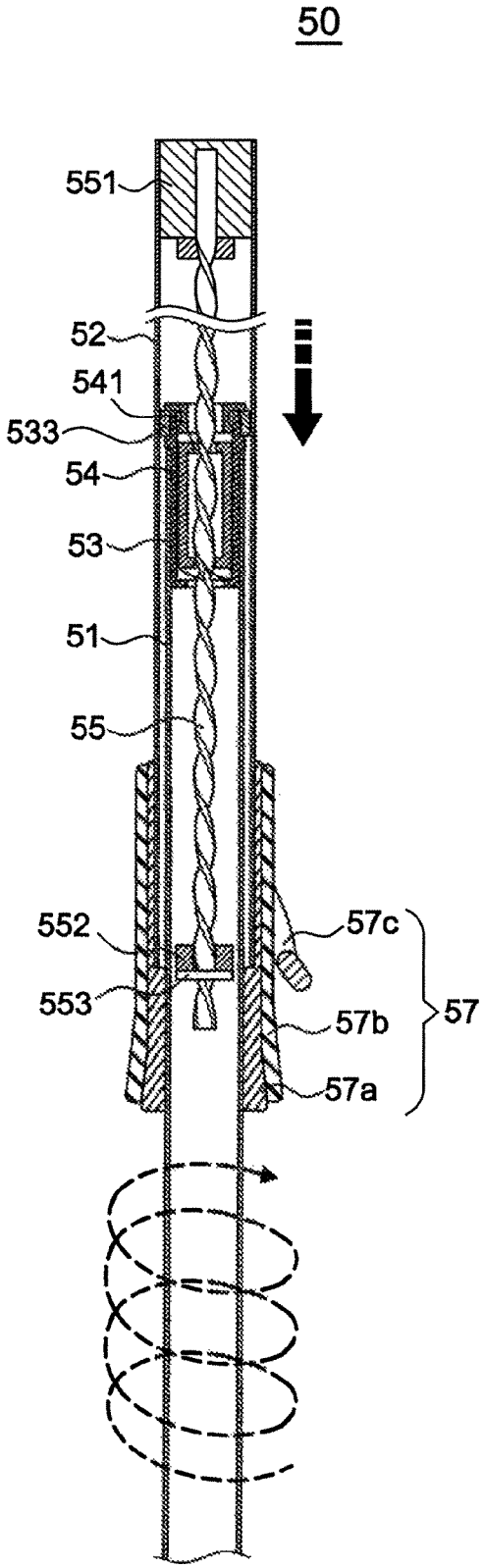
FIG. 14 is a schematic view of contracting and rotating a mop of the present invention by pressing it downward.
Figure 15:
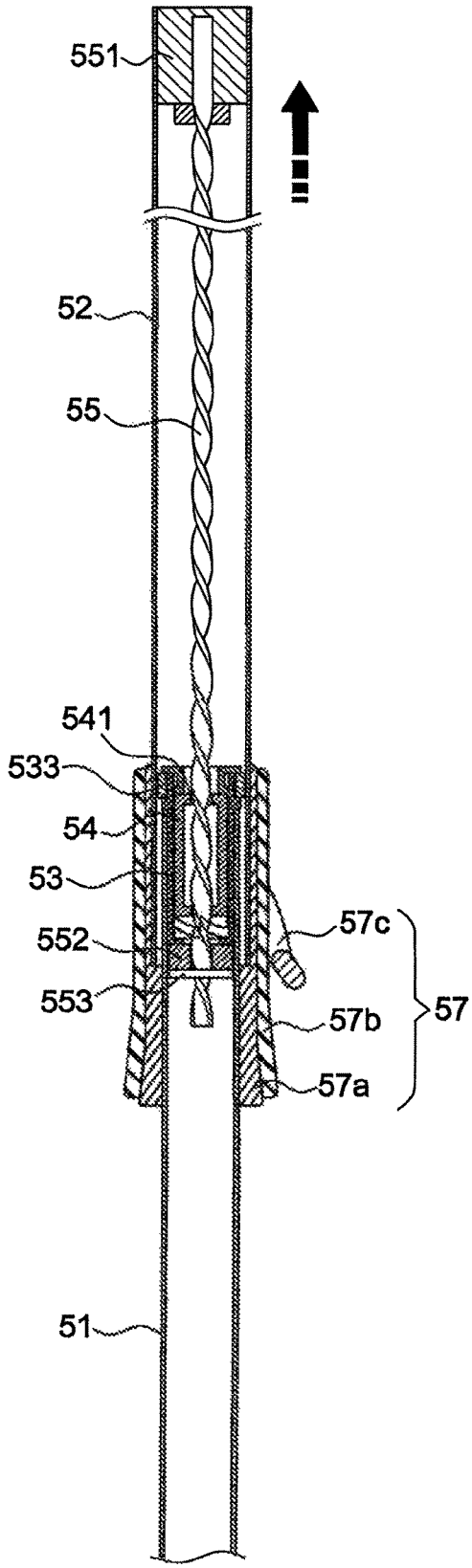
FIG. 15 is a schematic view of extending a mop of the present invention by pulling it upward.

Although the aforementioned mop 50 can be a general mop with cotton strips and cleaned or dewatered by rotating the handle by hands, the dual rotating dewater bucket 40 of the present invention further can be operated together with the mop 50 that converts linear up and down displacements into a unidirectional rotation to achieve the labor-saving and convenient effects. The mop in accordance with a preferred embodiment of the present invention as shown in FIGS. 10 to 15 comprises:

an internal rod 51, being a hollow circular rod, and made of metal or non-metal such as an aluminum tube or a plastic tube;

an external rod 52, with a lower end mounted with an upper end of the internal rod 51, and being contractible, extendable, and displaceable linearly with respect to each other, wherein in this preferred embodiment, a user holds the external rod 52 to ascend or descend on the external periphery of the internal rod 51, and having a handle 521 disposed at the top end of the external rod 52;

a latching element 53, installed inside an opening at an upper end of the internal rod 51, and mounted and positioned by a movable ring 533 and a fixing cover 534, and having a flange member 531 disposed at an external periphery of an upper end of the latching element 53, a through hole 5341 formed on a distal surface of the fixing cover 534, a flange surface 5342 with a larger area disposed at the external periphery of a fixing cover 534, and the bottom of the fixing cover 534 being extended and fixed into an opening 532 of the latching element 53, and a passive ratchet 535 is disposed upwardly from the bottom of an internal edge of the latching element 53 as shown in FIG. 11;

a driving element 55, being in a strip spiral shape, installed in the external rod 52, and ascended or descended synchronously with the external rod 52, and the driving element 55 of this preferred embodiment being latched into an upper pipe of the external rod 52 by a fixing member 551;

a brake element 54, installed in the latching element 53, for receiving the driving element 55, and the driving element 55 being formed by a screw rod or a spiral plate, such that an internal end of the brake element 54 comes with an assembly of a threaded sleeve 541; in other words, the brake element 54 has a thread or a long slot formed on an upper distal surface according to the structure of the screw rod or the spiral plate, such that when the driving element 55 is displaced linearly up and down by the external body 52, the brake element 54 is driven to rotate, and as shown in FIG. 11, the bottom of the brake element 54 opposite to the upwardly installed passive ratchet 535 of the latching element 53 includes a downwardly aligned active ratchet 542 in contact with the passive ratchet 535, and since the ratchet is aslant, the driving motion is directional, and when the brake element 54 is driven by the driving element 55 as shown in FIG. 14, the rotating direction of the ratchet is set, such as the brake element 54 can rotate the latching element 53 in a clockwise direction, and when the driving element 55 is pressed down, the brake element 54 is driven to drive the latching element 53 to rotate in a clockwise direction synchronously; on the other hand, when the driving element 55 as shown in FIG. 15 is pulled up, then the brake element 54 is driven to rotate counterclockwise, and now, the downwardly installed active ratchet 542 of the brake element 54 and the upwardly installed passive ratchet 535 of the latching element 53 are not engaged and they are idly rotated, that is, the latching element 53 remains still, and the driving element 55 can resume to its original position, and get ready for the next pressing to drive the latching element 53;

a disc 56, installed at the lower end of the internal rod 51, and having a plurality of cotton strips 561;

a locking structure 57, disposed at the external rod 52, for controlling the internal and external rods 51, 52 at a fixed position or at a relative contractible or extendible state, and the locking structure 57 of this preferred embodiment comprised of, but should not be limited to, an internal binding sleeve 57*a*, an external clamping cylinder 57*b* and a U-shaped wrench body 57*c*, and the locking structure 57 also can be applied by revolving and tightening the internal binding sleeve 57*a* and the external clamping cylinder 57*b* to fix the internal and external rods 51, 52 or extend or contract the internal and external rods 51, 52 with respect to each other.

In this preferred embodiment, if the U-shaped wrench body 57*c* is pressed down, the internal rod 51 and the external rod 52 are released from each other a contracting or extending state. If the U-shaped wrench body 57*c* is pulled upward, then the external clamping cylinder 57*b* will descend to force the internal binding sleeve 57*a* to be locked securely, so that the internal and external rods 51, 52 are situated at a fixed state.

With reference to FIG. 14, if the locking structure 57 is unlocked and the external rod 52 is pressed down, the driving element 55 is driven to descend synchronously, and passed through the threaded sleeve 541 of the brake element 54, such that the brake element 54 can rotate clockwise and synchronously drive the latching element 53 to rotate. Since the latching element 53 is secured onto the internal rod 51, therefore the internal rod 51 is driven to rotate in a single direction. As shown in FIG. 15, when the external rod 52 is pulled upward, and the brake element 54 is rotated counterclockwise, the latching element 53 is idly rotated, so that the internal rod 51 maintains its clockwise rotation due to the inertia, without being affected by the pulling of the external rod 52.

Therefore, the present invention adopts the dual rotating design for the dewater bucket 40 to achieve both effects of cleaning and dewatering the mop, together with a contractible and extendible rotating mop 50 to provide a convenient and user-friendly operation and a safe application.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A dual rotating dewater bucket, particularly the dual rotating dewater bucket having a first type of rotation for removing dirt from cotton strips of the mop and a second type of rotation for dewatering cotton strips of the mop, and the dual rotating dewater bucket comprising:

a) a bucket body, with an opening formed at the top surface of the bucket body, a higher first protruding base protruded from the bottom surface of the bucket towards the interior of the bucket body, and a lower second protruding base, and a portion of bucket wall of the bucket body corresponding to the second protruding base being a concave-convex surface;

b) a first support shaft, fixed to the first protruding base, and having an upper section protruded from the top surface of the first protruding base;

c) a second support shaft, fixed to the second protruding base, and having an upper section protruded from the top surface of the second protruding base;

d) a dewater basket, having a first shaft seat with an opening formed downwardly at the center of the bottom of the dewater basket, and mounted on the first support shaft, such that the dewater basket can be situated at a freely rotating state; and e) a spindle member, having a second shaft seat with an opening formed downwardly at the center of the bottom of the spindle member, and mounted on the second support shaft, such that a spindle member is at a freely rotating state, and the spindle member having a bearing seat disposed at the top surface of the spindle member, provided for being mounted onto the center of a bottom disc of a mop, and a mop being rotated synchronously with respect to the spindle member.

2. The dual rotating dewater bucket as recited in claim 1, wherein the concave-convex surface of the bucket body is in a wavy shape.

3. The dual rotating dewater bucket as recited in claim 1, wherein the bearing seat at the top surface of the spindle member is a protruding non-circular body, and the bottom disk of the mop corresponding to the bearing seat includes a sheath body disposed across the bearing seat for rotating synchronously.

4. The dual rotating dewater bucket as recited in claim 3, wherein the bearing seat is in a polygonal convex shape, and the sheath body is correspondingly in a shape of an inwardly concave polygonal cap.

5. A dual rotating dewater bucket and a mop thereof, particularly the dual rotating dewater bucket having a first type of rotation for removing dirt from cotton strips of the mop and a second type of rotation for dewatering cotton strips of the mop, and the dual rotating dewater bucket comprising:

a) a bucket body, with an opening formed at the top surface of the bucket body, a higher first protruding base protruded from the bottom surface of the bucket towards the interior of the bucket body, and a lower second protruding base, and a portion of bucket wall of the bucket body corresponding to the second protruding base being a concave-convex surface;

b) a first support shaft, fixed to the first protruding base, and having an upper section protruded from the top surface of the first protruding base;

c) a second support shaft, fixed to the second protruding base, and having an upper section protruded from the top surface of the second protruding base;

d) a dewater basket, having a first shaft seat with an opening formed downwardly at the center of the bottom of the dewater basket, and mounted on the first support shaft, such that the dewater basket can be situated at a freely rotating state; and e) a spindle member, having a second shaft seat with an opening formed downwardly at the center of the bottom of the spindle member, and mounted on the second support shaft, such that a spindle member is at a freely rotating state, and the spindle member having a bearing seat disposed at the top surface of the spindle member;

the mop comprising:

i) an internal rod, being in a hollow shape;

ii) an external rod, being in a hollow shape, and having a bottom mounted on the top end of the internal rod for a relative linear extending or contracting displacement;

iii) a latching element, installed inside an opening at the top end of the internal rod, and having a through hole formed at the bottom surface of the latching element, and a passive ratchet disposed at an internal bottom side;

iv) a driving element, being a strip spiral shape, and installed in the external rod, and ascended, descended, and displaced synchronously with the external rod;

v) a brake element, installed in the latching element, and having a threaded sleeve disposed on a top surface of the brake element for receiving the driving element, and an active ratchet disposed at a bottom end of the brake element and corresponding to the passive ratchet of the latching element, such that when the driving element rotates, the latching element is driven to rotate in a single direction only;

vi) a fixing cover, having a through hole for passing the driving element, and mounted on an opening of the latching element;

vii) a locking structure, disposed at the external rod, for controlling the internal and external rods at fixed positions or at a relative contracting and extending state; and viii) a disc, installed at the bottom of the internal rod, and having a plurality of cotton strips disposed at the bottom of the disc, and a sheath body disposed at the center of the bottom of the disc and across the bearing seat of the dewater bucket, such that when the disc is driven and rotated by the internal rod, the disc can be rotated 360° on the spindle member to drive the cotton strips to be spun towards the concave-convex surface of the bucket wall to stir and remove dirt on the cotton strips.

6. The dual rotating dewater bucket and a mop thereof as recited in claim 5, wherein the concave-convex surface of the bucket body has a bucket wall in a wavy shape.

7. The dual rotating dewater bucket and a mop thereof as recited in claim 5, wherein the bearing seat at the top surface of the spindle member is a protruding non-circular body, and the bottom disk of the mop corresponding to the bearing seat includes the sheath body disposed across the bearing seat and rotated synchronously.

8. The dual rotating dewater bucket and a mop thereof as recited in claim 7, wherein the bearing seat is in a polygonal convex shape, and the sheath body is correspondingly in a shape of an inwardly concave polygonal cap.

9. The dual rotating dewater bucket and a mop thereof as recited in claim 5, wherein the locking structure is comprised of an internal binding sleeve, an external clamping cylinder, and a U-shaped wrench body.

10. The dual rotating dewater bucket and a mop thereof as recited in claim 5, wherein the disc is placed in the dewater basket, such that when the disc is driven by the internal rod to rotate, the dewater basket is driven and rotated synchronously to dewatering the cotton strips of the disc centrifugally.

* * * * *